US006640533B2

(12) United States Patent
Bertini et al.

(10) Patent No.: US 6,640,533 B2
(45) Date of Patent: Nov. 4, 2003

(54) WIRE ROPE LUBRICATION

(75) Inventors: Glen J. Bertini, Tacoma, WA (US); Gerald S. Solomon, Everett, WA (US); Glenn S. Jessen, Everett, WA (US)

(73) Assignee: Utilx Corporation, Kent, WA (US)

( * ) Notice: Subject to any disclaimer, the term of this patent is extended or adjusted under 35 U.S.C. 154(b) by 0 days.

(21) Appl. No.: 10/020,836

(22) Filed: Dec. 11, 2001

(65) Prior Publication Data

US 2002/0050131 A1 May 2, 2002

Related U.S. Application Data

(62) Division of application No. 09/441,407, filed on Nov. 16, 1999, now Pat. No. 6,327,841.

(51) Int. Cl.[7] ..... D07B 1/16

(52) U.S. Cl. ..... 57/210; 57/212; 57/218; 57/221; 57/223

(58) Field of Search ..... 57/210, 211, 212, 57/217, 218, 221, 223, 231, 232, 236, 237, 241; 19/3

(56) References Cited

U.S. PATENT DOCUMENTS 2,162,130 A 6/1939 Somerville
4,120,145 A * 10/1978 Chiappetta et al. ..... 57/149
4,197,695 A * 4/1980 Hughes et al. ..... 57/7
4,344,278 A * 8/1982 Jamison et al. ..... 57/221
4,490,969 A * 1/1985 Simpson et al. ..... 57/217
4,606,183 A * 8/1986 Riggs ..... 57/221
4,635,432 A 1/1987 Wheeler
4,667,462 A * 5/1987 Smyth ..... 57/217
4,845,309 A * 7/1989 Vincent et al. ..... 174/23 C
5,505,773 A * 4/1996 Vitands et al. ..... 516/100
5,662,189 A 9/1997 Anderson et al.
5,714,093 A * 2/1998 Heimann et al. ..... 252/389.62
6,106,741 A * 8/2000 Heimann et al. ..... 252/389.3

FOREIGN PATENT DOCUMENTS

DE 604480 10/1934

* cited by examiner

*Primary Examiner*—John J. Calvert
*Assistant Examiner*—Shaun R Hurley
(74) *Attorney, Agent, or Firm*—Christensen O'Connor Johnson Kindness PLLC

(57) ABSTRACT

A wire rope 10 includes a plurality of strands 12. The strands are formed from individual wires or filaments 14. The strands are wound about a central axis. A conduit 16 also extends along said central axis. The conduit 16 has walls that are permeable to a lubricating compound. The lubricating compound is injected into the channel 18 defined by the conduit. The lubricating material migrates through the conduit wall and radially outwardly therefrom to provide lubrication to the individual strands and filaments comprising the wire rope.

12 Claims, 7 Drawing Sheets

WIRE ROPE LUBRICATION

CROSS-REFERENCE TO RELATED APPLICATION

This application is a divisional application of U.S. patent application Ser. No. 09/441,407, filed Nov. 16, 1999, now U.S. Pat. No. 6,327,841, issued Dec. 11, 2001, the disclosure of which is hereby expressly incorporated by reference.

FIELD OF THE INVENTION

This invention relates to wire ropes, and more particularly, to a method and apparatus for lubricating wire ropes.

BACKGROUND OF THE INVENTION

Wire ropes traditionally comprise a plurality of wires or filaments that are wound or twisted into multi-wire strands, which in turn are twisted about each other to form a wire rope. Wire ropes are used in a variety of applications including drag lines, elevators, bridges, hoists, and marine tow ropes. Wire ropes are stressed and relaxed numerous times during their life cycle. They also undergo frictional stress to a certain degree in straight pulls but more so when they traverse a sheave or are wound onto a drum. The wires and strands are thus caused to move in relation to each other causing wear in the rope. Wire ropes are lubricated to promote unrestricted movement of the rope, minimal fatigue and frictional wear. Lubrication also provides protection against rust and corrosion.

Wire ropes are typically lubricated from the outside with a lubricating material such as an oil or a grease. It is common to lubricate a wire rope by dripping oil on it or pulling it through an oil bath. Thick coats of grease have also been applied to wire ropes from the outside with the hope that the grease will penetrate into the interior of the rope. These methods of lubrication are not long-term solutions because the lubricants evaporate or are wiped away during normal use.

In recent years, wire rope manufacturers have tried other methods to lubricate wire ropes. For example, a solid core made of a porous polymer, or other absorbent material, has been positioned in a wire rope. The solid core is made of a polymer and a lubricant. When the core is stressed, lubricating material is squeezed from the solid core. These lubrication techniques are time limited because of the finite lubricant supply in the cores. Attempts have been made to replenish the lubricant in rope cores by pouring additional lubricant over the rope or pulling it through a bath. These methods have not proven to extend the life of a wire rope for any appreciable amount of time.

SUMMARY OF THE INVENTION

The present invention solves the shortcomings of the prior art methods for lubricating wire ropes by providing a wire rope having one or more channels or conduits running in the direction of the axis of the wire rope. The conduits are capable of receiving and carrying a lubricant or other performance enhancing material. A lubricant, for example, is injected axially along the channel. The lubricant diffuses out of the conduit and into the regions between the filaments and the strands comprising the wire rope to lubricate the wire rope during its use cycle. In a preferred embodiment, a lubricated wire rope includes a plurality of load-bearing strands wrapped about a central elongated axis. A first conduit is physically disposed within the plurality of load-bearing strands. The first conduit is adapted to permit a lubricating compound to flow therethrough. The conduit is permeable to the lubricating compound to permit a predetermined portion of the compound to diffuse through the first conduit into contact with the strands and the filaments making up the strands, thereby lubricating them.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
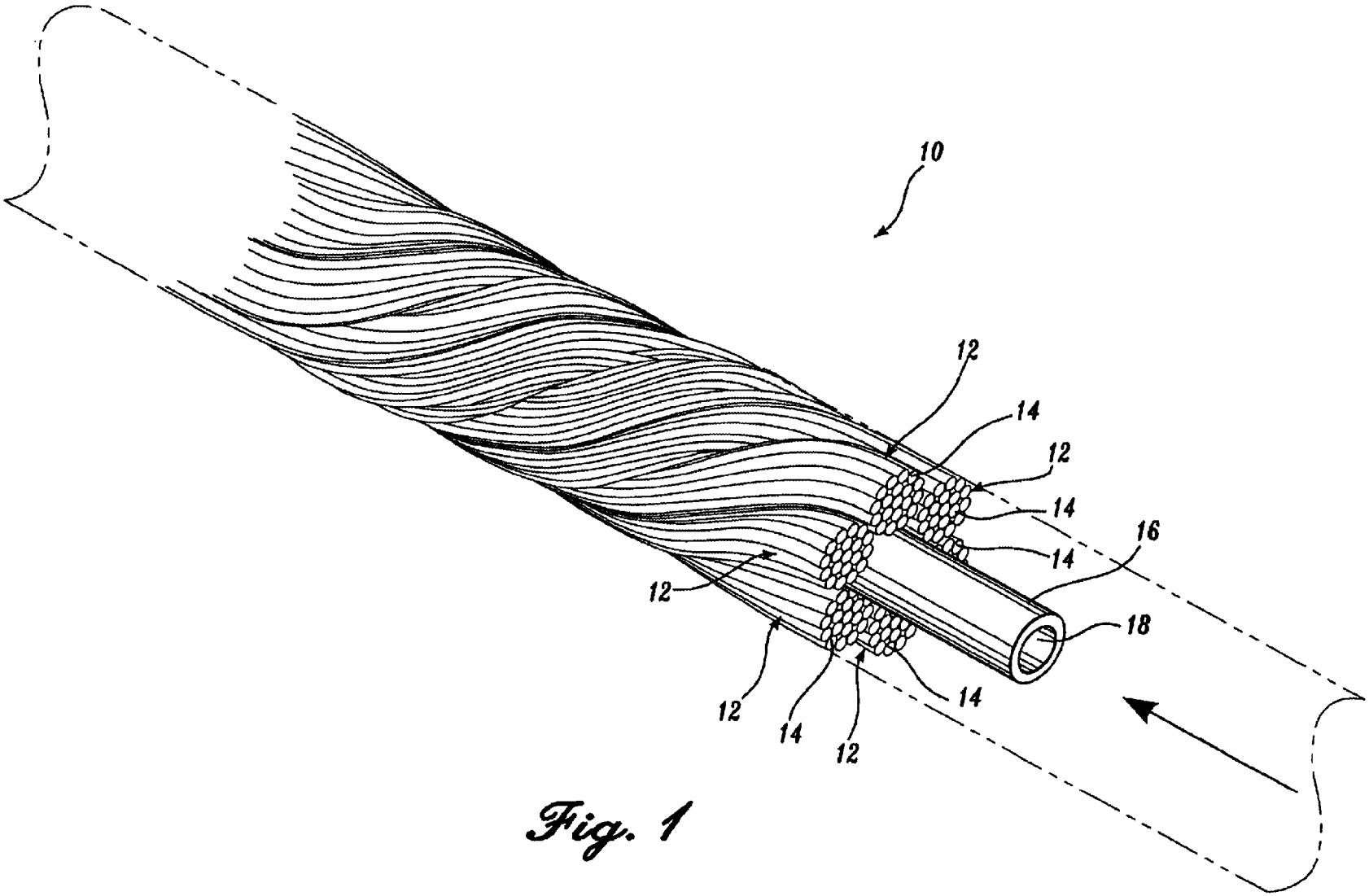
FIG. 1 is a perspective view of a wire rope constructed in accordance with the present invention.

Referring to FIG. 1, a wire rope 10 includes a plurality of load-bearing strands 12 that are wound about each other and a central axis to form a load-bearing wire rope 10. In a typical configuration, each of the strands is composed of a plurality of wires or filaments 14. These wires or filaments are first wound about each other to form a strand before the wire rope 10 is manufactured from a plurality of strands. As used herein the term strand refers both to a structure comprising a single wire or filament or multiple wires or filaments.

In accordance with the preferred embodiment of the present invention, a flexible conduit 16 is positioned along the axis of the wire rope 10. The conduit 16 has a central channel 18 for receiving a lubricating compound. In this embodiment, the conduit 16 runs along the axis of the wire rope 10 and the strands 12 are wound about the conduit 16.

The conduit 16 can be made of polyethylene, nylon, aromatic polyamides (e.g., Kevlar®), polytetrafluoroethylene, or other suitable polymeric materials. The conduit 16 is manufactured so that it is flexible and permeable to the performance enhancing compound. Thus the performance enhancing compound can diffuse radially outwardly through the conduit walls so that the lubricating material can come into contact with the strands 12. The conduit can also be made of other perforated or foraminous materials, for example, sintered metals.

The degree of permeability of the conduit 16 can be altered by one of ordinary skill in the manufacture of polymeric material to provide a rate of permeability that will satisfy the lubrication requirements of wire ropes in different applications. The rate of diffusion of the performance enhancing compound through the conduit walls can easily be regulated by one of ordinary skill by selectively choosing or altering the molecular size or structure of the lubricating compound (thus altering the diffusivity or solubility), the thickness of the conduit, the pressure at which the fluid is delivered, and finally the operating temperature of the wire rope.

The conduit 16 must have sufficient physical strength to be incorporated in the wire rope 10 and adequate thermal properties for use in maximum and minimum thermal environments in which the wire rope 10 may be used. Preferably, the conduit 16 has the thinnest wall possible to allow lubricating compound storage and free flow. The conduit 16 must also be capable of withstanding the normal operating temperatures of the wire rope. As a non-limiting example, the wall thickness of the conduit 16 is suitably between 1/64 and 1/32 of an inch. Although a cylindrical or nearly cylindrical geometry is the preferred geometry for the conduit 16, it should be apparent that other hollow geometries are also included within the scope of the present invention.

A wide variety of performance enhancing materials can be injected through the conduit 16. These include but are not limited to lubricants, corrosion inhibitors, antioxidants, UV stabilizers, water repellants, water-proofers, water scavengers, ion scavengers, and other performance improving materials and compounds. One of ordinary skill, once understanding the utility of the invention, will readily be able to inject a wide variety of other performance enhancing materials or compounds in accordance with the present invention.

The lubricating compounds especially useful in accordance with the present invention include a wide variety of existing lubricants that can flow through the channel 18 and diffuse through the walls of the conduit 16. Typical petroleum-based lubricants can be used with porous or foraminous conduits. Monomeric, oligmeric and low molecular weight polymeric silanes and siloxanes can also be used and have the capability of diffusing through the walls of selected solid polymeric tubes.

Where the conduit 16 is not foraminous or sintered, the lubricating materials must be of sufficiently low molecular weight to permeate through the polymeric conduit wall. Low molecular weight lubricants suffer from a short-lived presence on the surfaces to be lubricated due to their volatility and rapid surface transport resulting from their low viscosity. The present invention involves the use of an organosilicone fluid, which comprises silanes of the general formula $$(RO)_xSiR'_yR''_zR'''_{(4-x-y-z)}$$

where R denotes an aliphatic, aromatic, or an arene radical with 1 to 12 carbon atoms but preferably 1 to 2 carbon atoms, R' denotes an aliphatic, aromatic, or an arene radical with 1 to 12 carbon atoms, R" denotes an aliphatic, aromatic, or an arene radical with 1 to 12 carbon atoms, and R'" denotes an aliphatic, aromatic, or an arene radical with 1 to 12 carbon atoms and mixtures and partial hydrolysates thereof. The subscript "x" must be from 1 to 4, but preferably 2. The subscripts "y" and "z" are from 0 to 4, but the sum of x, y, z, and 4-x-y-z must be 4. The aliphatic, aromatic, or arene radicals may be substituted with halogens, hydroxy or other radicals without departing from the spirit of this invention. Such substitutions can be used to control the permeation rate, and add functionality such as UV stabilization or antioxidation or other desirable properties to extend the life of the wire rope. Examples of materials which are encompassed within this general formula are dimethyldimethoxysilane, dimethyldiethoxysilane, phenylmethyldimethoxysilane, naphthylmethyldiethoxysilane, methyltrimethoxysilane, and bromophenylethyldiethoxysilane.

The alkoxy functionality and especially dialkoxy functionality (x=2) designated in the general formula above as $$(RO)_x$$

solves the problem of the lubricant having too high a volatility and too low a viscosity. This alkoxy functionality provides for the hydrolysis and condensation reaction with water, which is ubiquitous in either the liquid or vapor state in the environments where the wire ropes are used, such that longer chain oligomers or polymers are formed shortly after the supplied lubricant diffuses out of the conduit 16. A mixture of compounds primarily made up on a molar basis with x=2 and a smaller molar amount with x-1 can be utilized to end-block the growing oligomer chain to prevent excess viscosity of the fully hydrolyzed material. For example, if the molar ratio of x=2 to x=1 were 50 to 1, the resulting siloxane mixture would have an average degree of polymerization of 25.

Alternatively, large viscosity increases could be encouraged where the application requires a higher viscosity, such as where the operating temperature is very high, by including a small molar ratio in the mixture of materials in which x=3 or x=4. Where alkoxy functionality exceeds 2, cross-linking of oligomer chains can yield gel-like or grease-like consistencies. For example, a mixture of 75–99% by weight of dimethyldimethoxysilane together with 1–25% by weight of methyltrimethoxysilane would result in lubricants with cross-linked chain structure and rheologies similar to greases used today in the wire rope industry. Thus, mixtures can be made of materials where the primary component has x=2, and smaller amounts of x=1 and/or x=3 or 4 can be blended to yield any desired rheology.

Other low viscosity, low molecular weight organic lubricants and other synthetic lubricants known in the art can also be used.

It is contemplated that during manufacture and use, it is possible that the conduit 16 can be pinched or crushed. One way to maintain an open channel 18 in a conduit 16 is to introduce a fluid into the tube under pressure during the manufacturing process. This would balance the inward pressure on the central conduit during normal swaging procedures and prevent the conduit from deforming or collapsing. This technique would also prevent collapse of the tube during compacting or swaging operations.

Figure 2A:
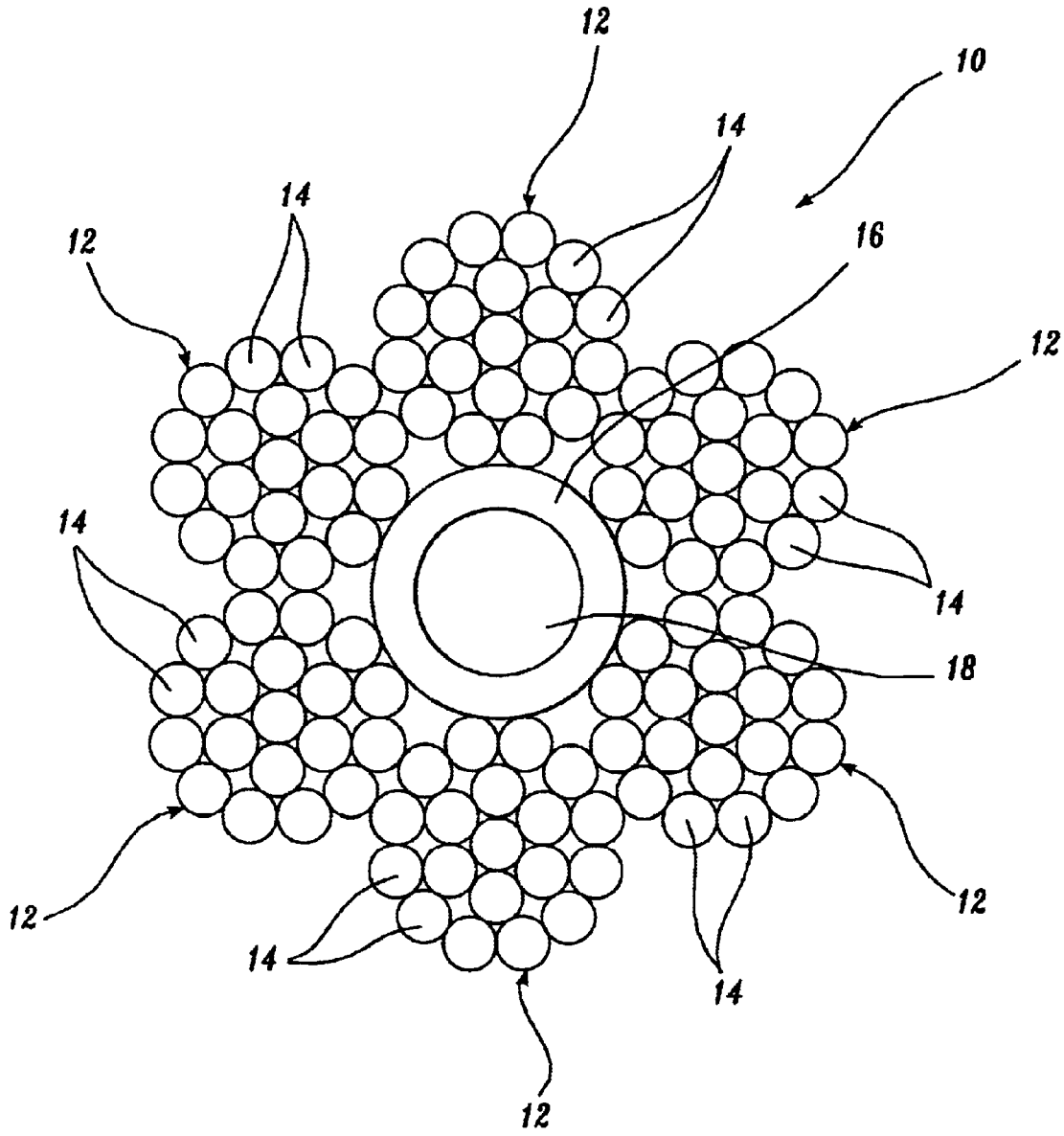
FIG. 2A is a cross section of the wire rope in FIG. 1.
Figure 2B:
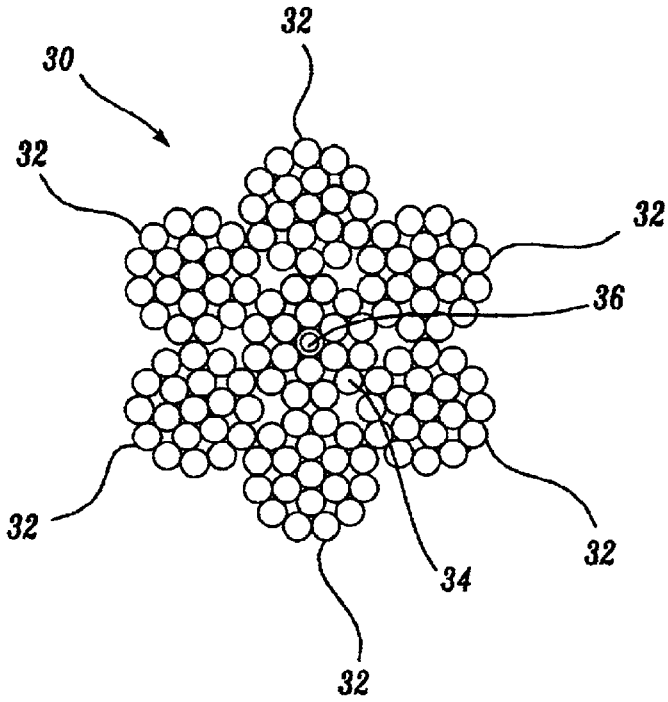
FIGS. 2B–2E are alternate embodiments of that shown and described in conjunction with FIG. 2A.

Referring now to FIG. 2B, the first alternate embodiment of a wire rope 30 incorporates the concepts of the present invention. The wire rope 30 comprises six strands 32 wound about a central core strand 34. Strand 34 is comprised of a plurality of individual wires or filaments that are wound about a central tube or conduit 36. The conduit 36 has a central channel into which performance enhancing materials or compounds can be injected. The performance enhancing materials can migrate through the conduit 36 radially outwardly into first the central strand 34 and then the exterior strands 32.

Figure 2C:
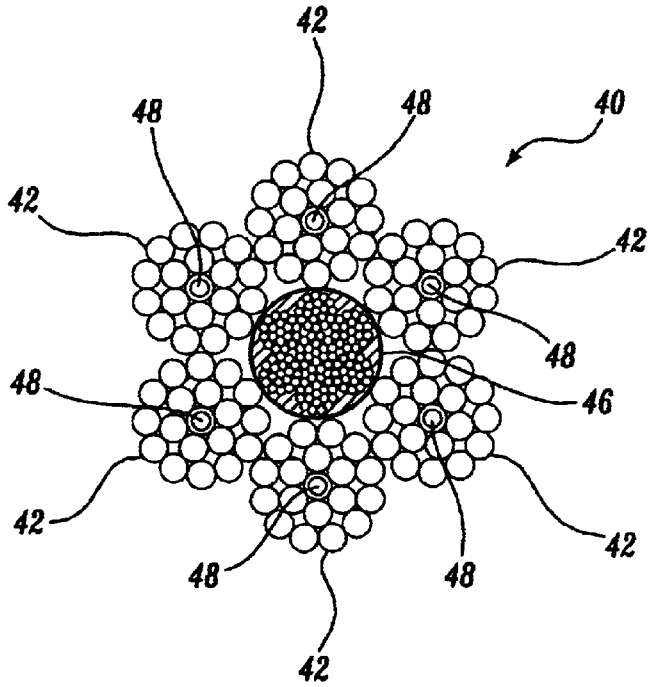

Referring to FIG. 2C, a wire rope 40 comprises six exterior strands 42 wound about a central strand 46. Central strand 46 is in turn comprised of several smaller strands that are encapsulated in a polyethylene jacket. The type of strand and jacket making up the central strand is described in further detail in conjunction with FIGS. 3A–3D. In this embodiment, the six outer strands 42 carry central conduits 48 into which performance enhancing fluids or materials can be injected. These performance enhancing materials again migrate outwardly through the wires or filaments comprising the individual strands 42.

Figure 2D:
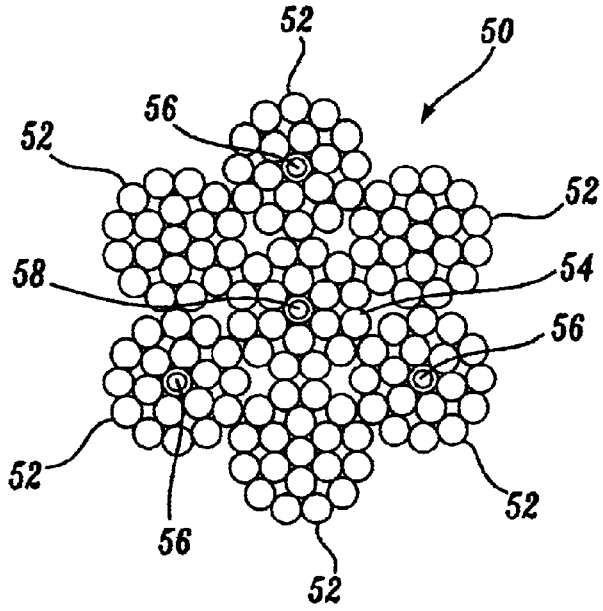

Referring to FIG. 2D, wire rope 50 comprises six outer strands 52 wound about a central core strand 54. Alternate ones of the outer strands 52 are composed of wires wound about a central conduit 56. Central strand 54 similarly carries a central conduit 58. Performance enhancing materials can be injected into the conduits 56 and 58 in a manner similar to that previously described.

Figure 2E:
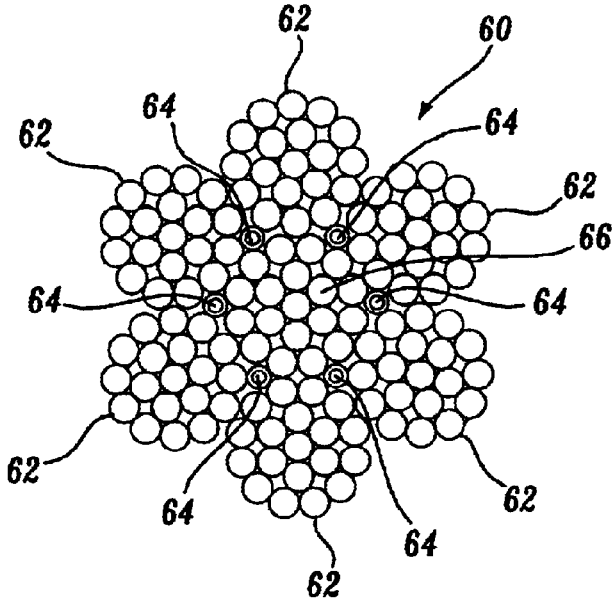

Finally, referring to FIG. 2E, yet another embodiment of a wire rope 60 comprises six outer strands 62 wound about a central core strand 64. In this embodiment, conduits 64 are not positioned within the individual strands but in the triangularly shaped cavities formed between two adjacent outer strands and the inner strand 64. Six of these cavities carry six conduits 64. Again, performance enhancing materials can be injected into these conduits 64 in a manner similar to that described above.

Figure 3A:
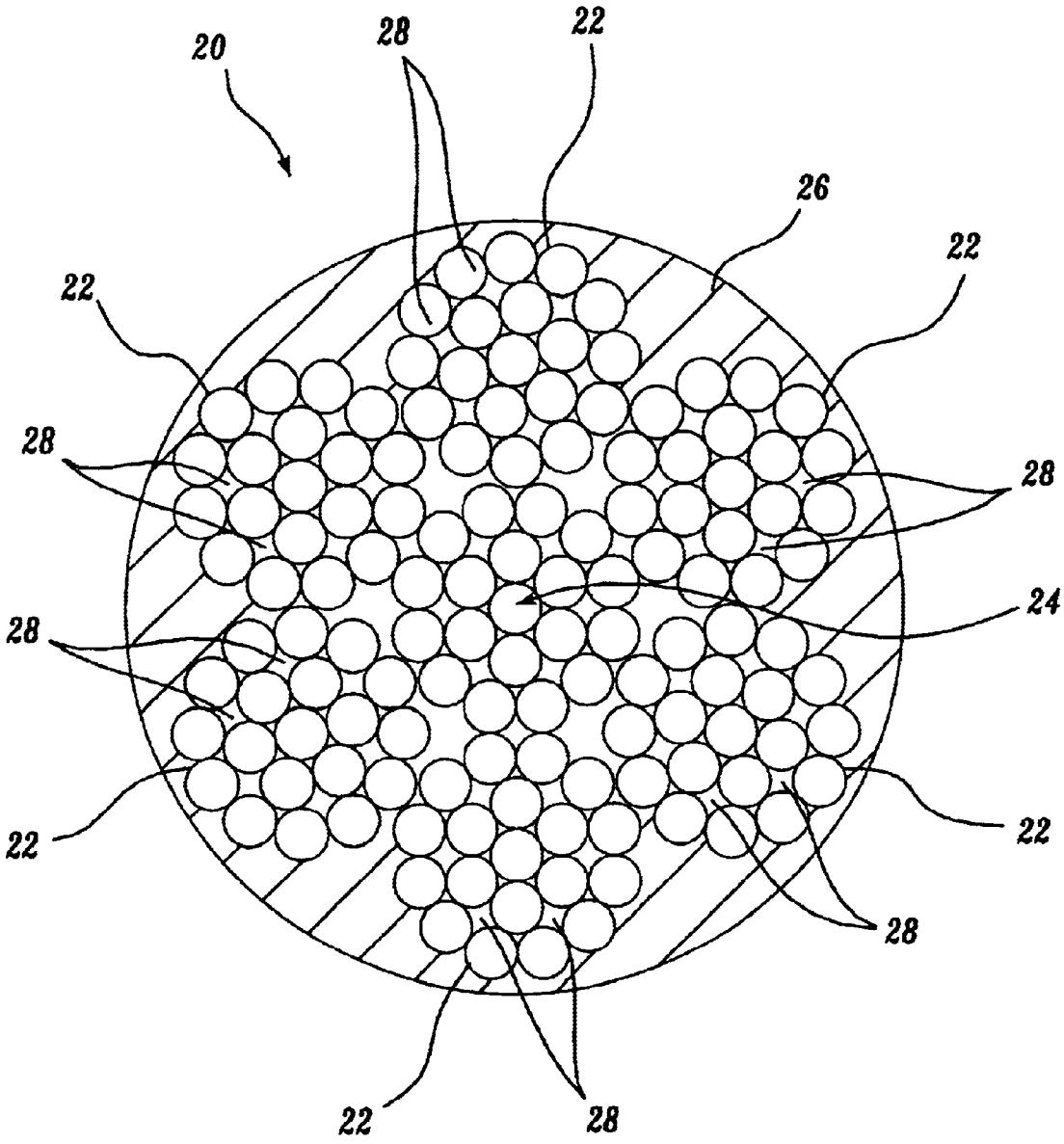
FIG. 3A is a cross section of an alternate embodiment of the wire rope of FIGS. 1 and 2.

Referring now to FIG. 3A, a cushioned core rope 20 is illustrated. A typical cushioned core rope is manufactured in the same manner as an ordinary wire rope. In this embodiment, the rope comprises strands 22 wound about a central strand 24. A polyethylene jacket 26 is extruded around the entire wire rope. The purpose of the polyethylene jacket is to provide a degree of cushioning and lubrication to the individual strands 22. While the polyethylene jacket is formed about the cushioned core rope 20, care is taken so that the polymeric material does not flow into the interstitial spaces or interstices 28 between the individual filaments of the strands 22. These interstices form a multiplicity of channels that spiral in an axial direction along the entire length of the cushioned core rope 20. In accordance with the present invention, it is possible to inject a performance enhancing material axially through these interstices 28 and provide additional lubrication to a cushioned core rope.

Figure 3B:
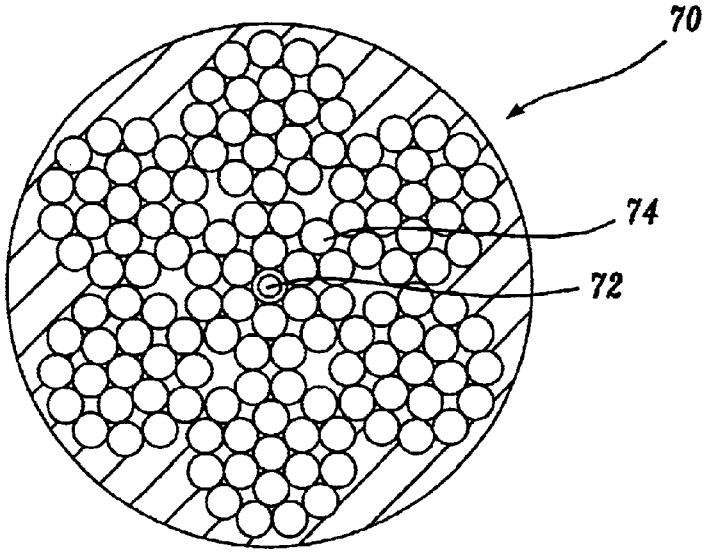
FIGS. 3B–3D are alternative embodiments of that shown and described in conjunction with FIG. 3A.

Referring now to FIG. 3B, a wire rope 70 of the cushioned core type described in conjunction with FIG. 3A has a central conduit 72 positioned in the central strand 74 of the rope 70. Individual wires of the central strand 74 are wound about the conduit 72. A performance enhancing material can be injected into the conduit 72 as described above.

Figure 3C:
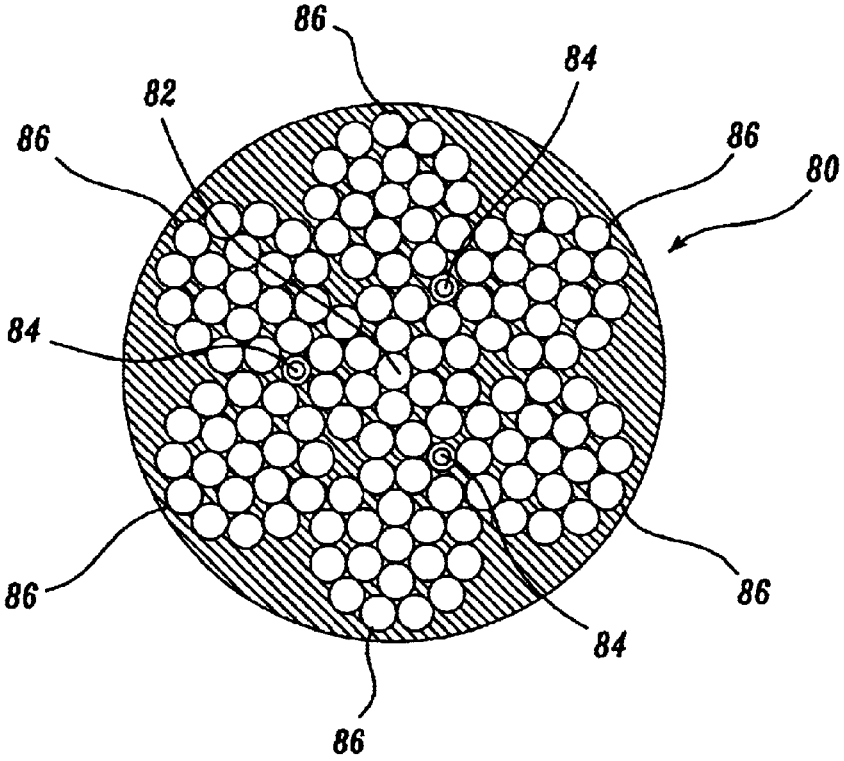

Referring to FIG. 3C, a cushioned core wire rope 80 is similar to that shown in FIG. 3B except the central conduit 72 is replaced by a wire or filament 82. Conduits 84 are positioned in alternating triangularly shaped regions created between two adjacent exterior strands 86 and central strand 82. In this embodiment, three conduits 84 are employed and positioned in alternating ones of the triangularly shaped regions. Performance enhancing materials can be injected into these conduits similar to that described above.

Figure 3D:
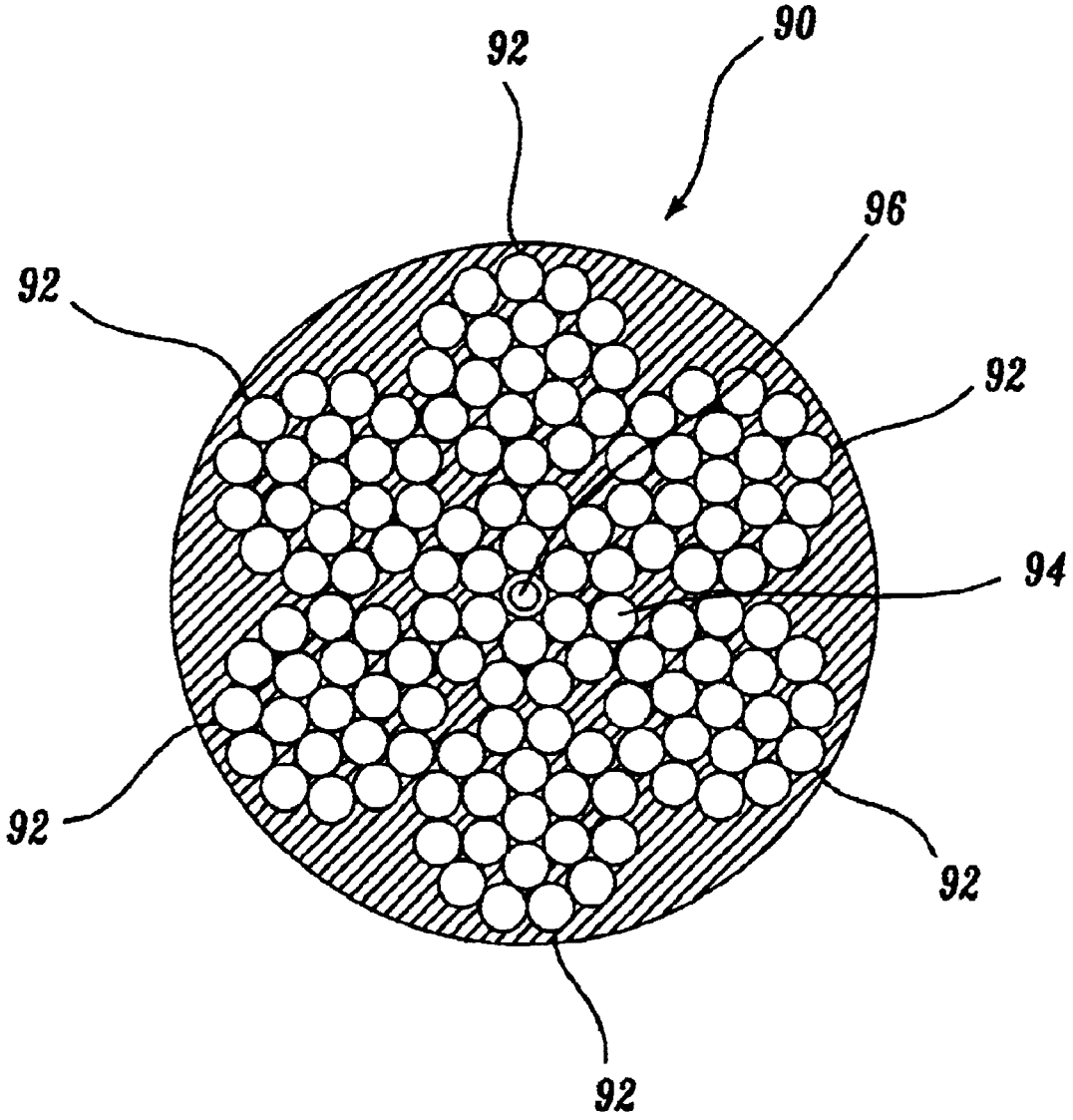

Finally, referring to FIG. 3D, cushioned core rope 90 is similar to that described in conjunction with FIG. 3B above. This embodiment, however, differs from that of FIG. 3B in that the interstitial spaces between the outer strands 92 and the inner strand 94 are filled with the cushioning material. A conduit 96 is positioned in the center of the central strand 94 replacing the central wire during manufacture. A performance enhancing material can be injected into conduit 96 in the manner similar to that described above.

One of ordinary skill will be able to devise a number of efficient ways to inject material into the channel 18 of the wire rope of FIG. 1 or 2 or through the interstices 28 of the cushioned core wire rope 20 of FIG. 3. A variety of connecting devices for injecting a fluid into electrical cable are disclosed in co-pending provisional patent application Ser. No. 60/155,279, filed Oct. 11, 1999, attorney docket No. UTLX-1-14551. These connecting devices can easily be adapted for use in conjunction with wire ropes.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A wire rope comprising:

(a) a plurality of multi-filament strands, said strands having interstices between the filaments thereof, wherein said strands engage adjacent strands to form cavities therebetween, the cavities running axially along the length of the wire rope;

(b) a polymeric jacket disposed about the strands, wherein the polymeric jacket is impeded from substantially entering the cavities by engagement of adjacent strands; and (c) a compound injected into said interstices of said wire rope.

2. The wire rope of claim 1, wherein the compound is also injected into the cavities.

3. The wire rope of claim 1, wherein the cavities are formed by three or more strands abutting one another along the length of the strands.

4. The wire rope of claim 1, wherein the plurality of multi-filament strands comprise a core multi-filament strand disposed along a center axis of the wire rope, wherein the remaining plurality of multi-filament strands are wound around the core multi-filament strand.

5. The wire rope of claim 1, wherein the filaments of each strand abut one another along the lengths of the filaments to impede the polymeric jacket from substantially entering the interstices.

6. The wire rope of claim 1, wherein the interstices are formed by three or more filaments abutting one another along the length of the filaments.

7. The wire rope of claim 1, wherein the compound is selected from a group consisting of lubricants, corrosion inhibitors, antioxidants, UV stabilizers, water repellants, water-proofers, water scavengers, ion scavengers, and mixtures thereof.

8. The wire rope of claim 1, wherein the compound is selected from the group consisting of petroleuth based lubricants, organosilicone fluids, and mixtures thereof.

9. The wire rope of claim 1, wherein the compound comprises an organo silicone fluid comprising a silane of the formula $$(RO)_x SiR'_y R''_z, R'''_{(4-x-y-z)}$$

wherein R comprises an aliphatic, aromatic or arene group having 1 to 12 carbon atoms, R' comprises an aliphatic, aromatic, or arene group having 1 to 12 carbon atoms, R" comprises an aliphatic, aromatic, or arene group having 1 to 12 carbon atoms, and R'" comprises an aliphatic, aromatic, or arene group having 1 to 12 carbon atoms and mixtures and partial hydrolysates thereof, and wherein x is from 1 to 4, y and z are from 0 to 4, and the sum of x, y, z and 4-x-y-z is 4.

10. The wire rope of claim 9, wherein x is 2.

11. The wire rope of claim 1, wherein the compound comprises a silane selected from the group consisting of dimethyldimethoxysilane, dimethyldiethoxysilane, phenylmethyldimethoxysilane, naphthylmethyldiethoxysilane, methyltrimethoxysilane, bromophenylethyldiethoxysilane, and mixtures and partial hydrolysates thereof.

12. A wire rope comprising:

(a) a plurality of multi-filament strands, said strands having interstices between filaments thereof, wherein said strands engage adjacent strands to form cavities therebetween, the cavities running axially along the length of the wire rope;

(b) a polymeric jacket disposed about the strands, wherein the cavities are substantially free of a material comprising the polymeric jacket; and (c) a performance enhancing compound disposed in said interstices of said strands.

* * * * *